US008692447B2

(12) United States Patent
Nakamura et al.

(10) Patent No.: US 8,692,447 B2
(45) Date of Patent: Apr. 8, 2014

(54) SPARK PLUG FOR INTERNAL COMBUSTION ENGINE AND MANUFACTURING METHOD THEREOF

(75) Inventors: Toru Nakamura, Inazawa (JP); Hiroaki Nasu, Gifu (JP)

(73) Assignee: NGK Spark Plug Co., Ltd. (JP)

( * ) Notice: Subject to any disclaimer, the term of this patent is extended or adjusted under 35 U.S.C. 154(b) by 787 days.

(21) Appl. No.: 12/756,828

(22) Filed: Apr. 8, 2010

(65) Prior Publication Data

US 2010/0259154 A1 Oct. 14, 2010

(30) Foreign Application Priority Data

Apr. 9, 2009 (JP) ..... 2009-94464

(51) Int. Cl.
*H01T 13/20* (2006.01)

(52) U.S. Cl.
USPC ..... 313/141; 445/7

(58) Field of Classification Search
USPC ..... 313/118–145; 445/7
See application file for complete search history.

(56) References Cited

U.S. PATENT DOCUMENTS

| | | | | |
|---|---|---|---|---|
| 5,982,080 | A | 11/1999 | Shibata et al. | 313/141 |
| 7,049,733 | B2 | 5/2006 | Lykowski et al. | 313/141 |
| 2005/0052106 | A1 * | 3/2005 | Tinwell et al. | 313/141 |
| 2005/0093412 | A1 * | 5/2005 | Lykowski et al. | 313/141 |

FOREIGN PATENT DOCUMENTS

| | | | |
|---|---|---|---|
| JP | 2007-511043 | 4/2007 | H01T 13/20 |

OTHER PUBLICATIONS

Office Action from a corresponding Japanese Application No. 2010089145, issued on Feb. 7, 2012. Japanese and English translation attached; 4 pages.

* cited by examiner

*Primary Examiner* — Anh T. Mai
*Assistant Examiner* — Andrew Coughlin
(74) *Attorney, Agent, or Firm* — Kusner & Jaffe

(57) ABSTRACT

A spark plug comprising: a center electrode extending along an axis; an insulator provided about the outer peripheral surface of the center electrode; a metal shell provided about the outer peripheral surface of the insulator; a noble metal tip provided at the leading end portion of the center electrode; one end of the ground electrode fixed at the leading end of the metal shell, and the other end of the ground electrode forming a gap with the leading end of the noble metal tip; a stopper preventing the noble metal tip from moving relative to the central electrode; a molten portion formed by irradiating laser or electron beam; and a closed space formed between the basal portion of the noble metal tip and the center electrode. The molten portion welds the center electrode and a part of the basal portion of the noble metal tip.

5 Claims, 10 Drawing Sheets

SPARK PLUG FOR INTERNAL COMBUSTION ENGINE AND MANUFACTURING METHOD THEREOF

CROSS-REFERENCE TO RELATED APPLICATIONS

This application claims priority from Japanese Patent Application No. 2009-094464 filed on Apr. 9, 2009, the entire subject matter of which is incorporated herein by reference.

TECHNICAL FIELD

The present invention relates to a spark plug for use in an internal combustion engine and a method for manufacturing the same.

BRIEF DESCRIPTION OF THE RELATED ART

In general, a spark plug used in an internal combustion engine such as automobile engine or the like is configured to ignite an air-fuel mixture provided in a combustion chamber of the internal combustion engine by generating a spark at a spark gap between a center electrode and a ground electrode.

In recent years, from the point of view of regulations on exhaust gas and improvement of fuel efficiency, the internal combustion engine such as a lean-burn engine, a direct-fuel injection engine, a low-exhaust gas engine or the like has been actively developed. For such an internal combustion engine, a spark plug with the excellent ignition performance is required, in comparison with a related art.

Consequently, in order to prevent deterioration of wear resistance and improve the ignition performance, it is widely found to weld the leading end of the center electrode with a cylindrical columnar noble metal tip made of noble metal alloy with excellent wear resistance such as iridium alloy or platinum alloy.

The welding of the noble metal tip to the leading end of the center electrode is generally formed by the following process. That is, after one end surface of the noble metal tip is placed on the leading end surface of the center electrode, the other end surface of the noble metal tip is pressed by a predetermined push pin to maintain the noble metal tip. While the axis of the center electrode or the like is rotated around a rotational shaft, a laser beam or electron beam irradiates the vicinity of an outer edge of a contact surface of the center electrode and the noble metal tip from a radial direction of the center electrode or the like. As a result, a molten portion constituted of metal materials of the center electrode and the noble metal tip by the welding is formed between the center electrode and the noble metal tip, and, as a result, the noble metal tip is welded to the leading end of the center electrode.

In a case of using such a technique, when the center electrode or the like is rotated, there is concern that the center axis of the noble metal tip may be offset (so-called eccentric) from the center axis of the center electrode. If the laser welding or the like is performed in a state in which the noble metal tip is eccentric with respect to the center electrode, a variation in the distance from a laser radiation port to an irradiation target (outer edge of the contact surface) is generated. As a result, since the molten portion varies its size (melting amount) along the peripheral direction, the welding strength may be deteriorated.

In order to prevent the eccentricity of the noble metal tip at the time of welding, there has been proposed a technique of welding the noble metal tip to the center electrode by forming a hole of a concave shape in the leading end surface of the center electrode, forming a protrusion on a basal end surface of the noble metal tip, and fitting the protrusion into the hole (e.g., refer to JP-A-10-112374).

In the above-mentioned technique, the bottom surface of the hole comes into contact with the end surface of the protrusion so as to efficiently transfer the heat from the noble metal tip to the center electrode. In addition, a molten portion is formed on an outer circumference portion between the basal end surface of the noble metal tip and the leading end surface of the center electrode, a welded portion is not formed between the end surface of the protrusion and the bottom surface of the hole, and the end surface and the bottom surface are welded by resistance welding. For this reason, there is concern that stress may be generated on the contact surface between the end surface of the protrusion and the bottom surface of the hole of the center electrode on which the welded portion is not formed, due to a difference of thermal expansion coefficients between the noble metal alloy constituting the noble metal tip and the metal material constituting the center electrode. As a result, there is concern that cracks may be generated on the jointed portion of the protrusion and the hole, and thus the noble metal tip may be peeled off from the center electrode.

Accordingly, it is considered to relieve the stress by installing the welded portion having a thermal expansion coefficient between the center electrode and the noble metal tip over the overall area of the contact portion between the center electrode and the noble metal tip, thereby preventing the noble metal tip from being peeled off.

In order to form the welded portion on the overall area of the contact portion between the center electrode and the noble metal tip, it is required to increase the melting energy of the laser beam or the like. If the melting energy is increased, there is concern that the molten portion becomes excessively large, or particles (i.e., sputter) of metal from the molten portion are dispersed, so that the melting metal may be adhered to the leading end surface of the noble metal tip. If the melting metal is adhered to the leading end surface of the noble metal surface, since the size of the spark gap is not be accurately adjusted, a discharge voltage required for the spark discharge becomes high, and thus there is concern that accidental fire may occur in the worst case. In addition, if the melted portion becomes excessively large, it may cause the deterioration in the wear resistance.

SUMMARY

The exemplary embodiments of the present invention have been made in view of the above-described circumstances. One advantage of the exemplary embodiments is to provide a spark plug for an internal combustion engine and a method for manufacturing the same which can increase the welding strength of a noble metal tip with respect to the center electrode and reliably improve the peeling resistance of the noble metal tip without inviting deterioration in wear resistance and ignitability.

Hereafter, some aspects of the exemplary embodiments of the present invention for achieving the above-described advantage will be described. In addition, when necessary, operational effects will be added to each configuration.

The first aspect of the exemplary embodiments of the present invention is a spark plug comprising: a center electrode extending along an axis and having a leading end portion and an outer peripheral surface; an insulator of a cylindrical shape, the insulator provided about the outer peripheral surface of the center electrode and having an outer peripheral surface; a metal shell of a cylindrical shape, the metal shell provided about the outer peripheral surface of the insulator and having a leading end portion; a noble metal tip provided at the leading end portion of the center electrode, the noble metal tip including a leading end portion and a basal portion; a ground electrode, one end of the ground electrode being fixed to the leading end portion of the metal shell, and the other end of the ground electrode forming a gap with the leading end portion of the noble metal tip; a stopper provided on at least one of the center electrode and the noble metal tip, the stopper preventing the noble metal tip from moving relative to the central electrode; a molten portion formed by an irradiating laser or electron beam, the molten portion welding the center electrode and at least a part of the basal portion of the noble metal tip; and a closed space formed between a center part of the basal portion of the noble metal tip and the center electrode.

The stopper is preferably configured to restrict the relative movement of the noble metal tip in a radial direction with respect to the center electrode, and, for example, may be comprised of a concave portion formed on the basal end portion of the noble metal tip and a projection that may be formed on the leading end portion of the center electrode and fitted into the concave portion. Further, the stopper may be comprised of a concave portion installed on the leading end portion of the center electrode and receiving the cylindrical columnar noble metal tip.

According to the first aspect of the exemplary embodiments, at the time of welding the noble metal tip, relative movement of the noble metal tip in a radial direction with respect to the center electrode is restricted by the stopper. For this reason, at the time of welding, it is possible to more reliably prevent generation of a variation of the size of the molten portion due to the eccentricity of the noble metal tip, thereby promoting the improvement of the welding strength.

Further, in the spark plug according to the first aspect of the exemplary embodiments, the closed space is formed between a center portion of the basal end portion of the noble metal tip and the center electrode. That is, at the time of welding the noble metal tip, the molten portion is formed such that a space is formed between the center electrode and the noble metal tip. Accordingly, comparing it with a state in which the overall area of the leading end surface of the center electrode comes into contact with the overall area of the basal end surface of the noble metal tip, the contact portion between the center electrode and the noble metal tip is decreased, so that the molten portion can be formed on the overall area of the contact portion of the center electrode and the noble metal tip, without increasing the melting energy. As a result, while preventing the adhering (welding fault) of melting metal to the leading end surface of the noble metal tip, which is a factor causing the wear resistance and the ignition performance to deteriorate, it is possible to relieve the stress generated between the center electrode and the noble metal tip, thereby improving the peeling resistance of the noble metal tip. That is, according to configuration 1, it is possible to suppress the welding fault and the oxidized scale by one effort.

The second aspect of the exemplary embodiments of the present invention is the spark plug of the first aspect, further comprising that when the spark plug is viewed in a cross section including the axis, a width of the noble metal tip CO, a width of the closed space SI, and a height of the closed space SH satisfy relationships:

$$SI \leq CO/2; \text{ and} \quad (1)$$

$$SH \leq SI \quad (2)$$

In the second aspect of the exemplary embodiment, the width of the noble metal tip means a length of the noble metal tip along a direction perpendicular to the axis, and the width of the closed space means a length of the closed space along the direction perpendicular to the axis. In addition, in an example where the width of the noble metal tip is different, i.e., varies, along the axis, the width of the noble metal tip means a width of the basal end portion of the noble metal tip. Moreover, the height of the closed space means a length of the closed space along the axis in the cross section. In addition, in an example where the width of the closed space is different, i.e., varies, along the axis, the width SI of the closed space means the maximum value of the width, and in a case where the height of the closed space is different along a radial direction (perpendicular to the axial direction), the height SH of the closed space means the maximum value of the height (the same as below).

As described above, the closed space is formed between the noble metal tip and the center electrode according to the exemplary embodiments of the present invention. Herein, in view of the heat transfer from the noble metal tip to the center electrode, the heat of the noble metal tip is transferred to the center electrode side via an annular portion positioned at the outer circumference of the closed space. For this reason, if the sectional area of the annular portion is excessively small or the annular portion is extremely long, the heat transfer from the noble metal tip to the center electrode side is deteriorated, so that the wear resistance of the noble metal tip may be damaged.

In this regard, according to the second aspect, since SI≤CO/2 or SH≤SI, it is possible to render the annular portion serving as a heat transfer path to have a sufficient sectional area, and simultaneously to relatively shorten it. For this reason, it is possible to sufficiently ensure the heat-drawing performance of the noble metal tip, thereby it is possible to promote the improvement of the wear resistance.

The third aspect of the exemplary embodiments of the present invention is the spark plug of the first aspect, further comprising that when the spark plug is viewed in a cross section including the axis, a width of the noble metal tip CO, a width of the closed space SI, a depth of the molten portion at one side of the axis LA, and a depth of the molten portion at the other side of the axis LB satisfy relationships:

$$LA \geq \{(CO-SI)/2\} \times 0.7; \text{ and} \quad (3)$$

$$LB \geq \{(CO-SI)/2\} \times 0.7 \quad (4)$$

In this third aspect, the 'depth of the molten portion' means a length in a direction perpendicular to the axis between the portion positioned at the most leading end side of the molten portion in the axial direction and the portion positioned at the innermost position of the molten portion.

According to the third aspect, the molten portion of which the molten depth LA and LB are formed to be sufficiently deepened by 0.7 times the half [(CO−SI)/2] of the length of the contact region of the noble metal tip and the center electrode. That is, it is possible to more reliably absorb the stress difference occurring between the center electrode and the noble metal tip by the sufficiently deep molten portion. As a result, it is possible to prevent the development of the oxidized scale (crack) between the center electrode and the noble metal tip, thereby further improving the peeling resistance of the noble metal tip.

The fourth aspect of the exemplary embodiments of the present invention is the spark plug of the first aspect, further comprising that the molten portion is not exposed to the closed space.

According to the fourth aspect, the molten portion is formed in such a manner that the molten portion is not exposed to the closed space. In other words, when the molten portion is formed, according to the present invention, the gas existing in the closed space is not introduced into the molten pool. This prevents bubbles on the surface of the molten portion (i.e., generation of so-called blow hole). For this reason, it is possible to effectively prevent the strength of the molten portion from being deteriorated.

The fifth aspect of the exemplary embodiments of the present invention is a manufacturing method of a spark plug for an internal combustion engine comprising: a center electrode extending along an axis and having a leading end portion and an outer peripheral surface; an insulator of a cylindrical shape, the insulator provided about the outer peripheral surface of the center electrode and having an outer peripheral surface; a metal shell of a cylindrical shape, the metal shell provided about the outer peripheral surface of the insulator and having a leading end portion; a noble metal tip provided at the leading end portion of the center electrode, the noble metal tip including a leading end portion and a basal portion; a molten portion formed by melting the central electrode and the noble metal tip; a stopper provided on at least one of the central electrode and the noble metal tip; and a ground electrode, one end of the ground electrode fixed at a leading end portion of the metal shell, and the other end of the ground electrode forming a gap between the leading end portion of the noble metal tip. The method comprises: forming a closed spaced between the center electrode and a center portion of the basal portion of the noble metal tip; mounting the noble metal tip on the leading end portion of the center electrode while the stopper prevents the noble metal tip from moving relative to the center electrode; forming the molten portion at a portion where a surface of the leading end portion of the center electrode and a surface of the basal portion of the noble metal tip contact by melting the center electrode and the noble metal tip with an irradiating laser or electron beam focused at an outer surface of a boundary between the center electrode and the noble metal tip; and welding the center electrode and the noble metal tip through the formation of the molten portion.

According to the fifth aspect, it has basically the same working effect as the first aspect.

The sixth aspect of the exemplary embodiments of the present invention is the method of the fifth aspect, further comprising that when the spark plug is viewed in a cross section including the axis, a width of the noble metal tip CO, a width of the closed space SI, and a height of the closed space SH satisfy relationships:

$$SI \leq CO/2; \text{ and}$$

$$SH \leq SI$$

According to the sixth aspect, it has basically the same working effect as the second aspect.

The seventh aspect of the exemplary embodiment of the present invention is the method of the fifth aspect that when the spark plug is viewed in a cross section including the axis, a width of the noble metal tip CO, a width of the closed space SI, a depth of the molten portion at one side of the axis LA, and a depth of the molten portion at the other side of the axis LB satisfy relationships:

$$LA \geq \{(CO-SI)/2\} \times 0.7; \text{ and}$$

$$LB \geq \{(CO-SI)/2\} \times 0.7.$$

According to the seventh aspect, it has basically the same working effect as the third aspect.

The eighth aspect of the exemplary embodiments of the present invention is the method of the fifth aspect, further comprising that the laser or the electron beam is irradiated so that the molten portion is not exposed to the closed space in the method of the fifth aspect.

According to configuration 8, it has basically the same working effect as configuration 4.

The ninth aspect of the exemplary embodiments of the present invention is the method of the fifth aspect, further comprising that the stopper is a recess formed at a center of the leading end portion of the center electrode; and the stopper prevents the noble metal tip from moving relative to the center electrode by fitting the noble metal tip into the recess.

According to the ninth aspect, it is possible to restrict the relative movement of the noble metal tip with respect to the center electrode only by machining the center electrode, without specially machining the noble metal tip. Consequently, it is possible to prevent increase of a manufacturing cost due to the machining of the noble metal tip and to prevent deterioration of the productivity due to the machining both the center electrode and the noble metal tip.

DESCRIPTION OF EXEMPLARY EMBODIMENTS

Figure 1:
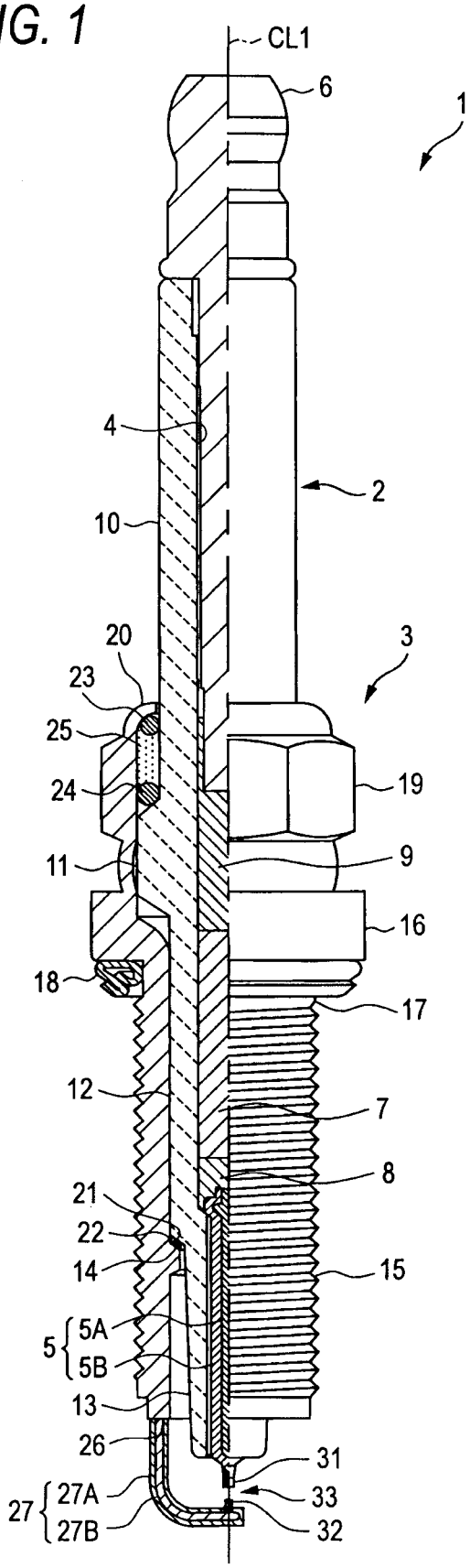
FIG. 1 is a partial-cross-sectional front view showing the configuration of a spark plug according to an exemplary embodiment.

An exemplary embodiment will now be described with reference to the drawings. FIG. 1 is a partial-cross-sectional front view of a spark plug 1 for use in an internal combustion engine (hereinafter, referred to as 'spark plug') 1. Notably, in FIG. 1, the spark plug 1 is depicted in such a manner that the direction of an axis CL1 which passes through the center of the spark plug 1 coincides with the vertical direction in FIG. 1. Further, in the following description, the lower side of FIG. 1 will be referred to as the leading end side of the spark plug 1, and the upper side of FIG. 1 will be referred to as the rear end side of the spark plug 1.

The spark plug 1 includes a cylindrical insulator 2 serving as an insulating member, and a cylindrical metal shell 3 holding the insulator 2 therein.

As is well known, the insulator 2 is made of alumina or the like by firing. The insulator 2 includes in its outer configuration portion a rear end-side body 10 formed on the rear end side thereof, a large-diameter portion 11 protruding radially outward at a position closer to the leading end side than the rear end-side body 10, and an intermediate body 12 formed closer to the leading end side than the large-diameter portion 11. The intermediate body 12 had a diameter smaller than that of the large-diameter portion 11. The insulator 2 further includes a leading end-side body 13 formed closer to the leading end side than the intermediate body 12 and having a diameter smaller than that of the intermediate body 12. Of the insulator 2, the large-diameter portion 11, the intermediate body 12, and the major part of the leading end-side body 13 are accommodated within the metal shell 3. A tapered step 14 is formed at a connection portion between the leading end-side body 13 and the intermediate body 12. The insulator 2 is engaged with the metal shell 3 at the step 14.

Further, the insulator 2 has an axial hole 4 which extends through the insulator 2 along the axis CL1. A center electrode 5 is inserted into and fixed to a leading end side of the axial hole 4. The center electrode 5 is formed in a rod-like shape (cylindrical columnar shape) as a whole, and protrudes from the leading end of the insulator 2. Further, the center electrode 5 includes an inner layer 5A made of copper or a copper alloy, and an outer layer 5B made of a Ni alloy containing nickel as a main component thereof. In addition, a noble metal tip 31 of a cylindrical columnar shape which is made of a noble metal alloy (e.g., iridium alloy) is joined to a leading end of the center electrode 5.

Further, a terminal electrode 6 is inserted into and fixed to a rear end side of the axial hole 4 such that the terminal electrode 6 protrudes from the rear end of the insulator 2.

Further, a cylindrical columnar resistor 7 is disposed between the center electrode 5 and the terminal electrode 6 of the axial hole 4. Both end portions of the resistor 7 are electrically connected to the center electrode 5 and the terminal electrode 6, respectively, via electrically conductive glass seal layers 8 and 9, respectively.

The metal shell 3 is made of metal such as low carbon steel and is formed in a cylindrical shape. A threaded portion (external threaded portion) 15 for mounting the spark plug 1 onto an engine head is formed on the outer peripheral surface of the metal shell. A base 16 is formed on the outer peripheral surface of the rear end side of the threaded portion 15. A ring-shaped gasket 18 is fitted onto a neck potion 17 at the rear end of the threaded portion 15. A tool engagement portion 19 having a hexagonal cross-section shape is provided at the rear end side of the metal shell 3 so that a tool, such as a wrench, engages with the tool engagement portion 19 when the spark plug 1 is mounted to the engine head. Further, a crimping portion 20 is provided at the rear end side of the metal shell to hold the insulator 2 at the rear end portion.

Further, a tapered step 21 to which the insulator 2 is engaged is provided on the inner peripheral surface of the metal shell 3. The insulator 2 is inserted into the metal shell 3 from the rear end side of the metal shell 3 toward the leading end side. In a state in which the step 14 of the insulator 2 is engaged with the step 21 of the metal shell 3, a rear end-side opening portion of the metal shell 3 is crimped radially inward. That is, the crimping portion 20 is formed, so that the insulator 2 is fixed. In this instance, an annular plate packing 22 is interposed between the step 14 of the insulator 2 and the step portion 21 of the metal shell 3. Thus, the air-tightness of a combustion chamber is maintained, so that a fuel air mixture which enters the clearance between the inner peripheral surface of the metal shell 3 and the leading end-side body 13 of the insulator 2 exposed to the interior of the combustion chamber does not leak to the outside.

Moreover, in order to render the sealing by the crimping more complete, on the rear end side of the metal shell 3, annular ring members 23 and 24 are interposed between the metal shell 3 and the insulator 2, and powder of talc 25 is filled in the space between the ring members 23 and 24. That is, the metal shell 3 holds the insulator 2 by a plate packing 22, the ring members 23 and 24, and the talc 25.

A rod-shaped ground electrode 27 is joined to a leading end 26 of the metal shell 3 in a rod shape. An approximate middle portion of the ground electrode 27 is bent radially inwardly so that the side surface thereof faces the leading end of the center electrode 5. The ground electrode 27 includes a double-layered structure which includes an outer layer 27A and an inner layer 27B. In this embodiment, the outer layer 27A is made of a Ni alloy (e.g., INCONEL 600 or INCONEL 601 (both of which are trademark)). The inner layer 27B is made of a copper alloy or pure copper which is a metal with thermal conductivity higher than the Ni alloy.

In addition, a noble metal chip 32 of a cylindrical columnar shape, which is made of a noble metal alloy (e.g., a Pt alloy or the like), is joined to a portion of the ground electrode 27 opposite to the leading end surface of the noble metal tip 31. A spark discharge gap 33 is formed between the noble metal tips 31 and 32 as a gap.

Figure 2:
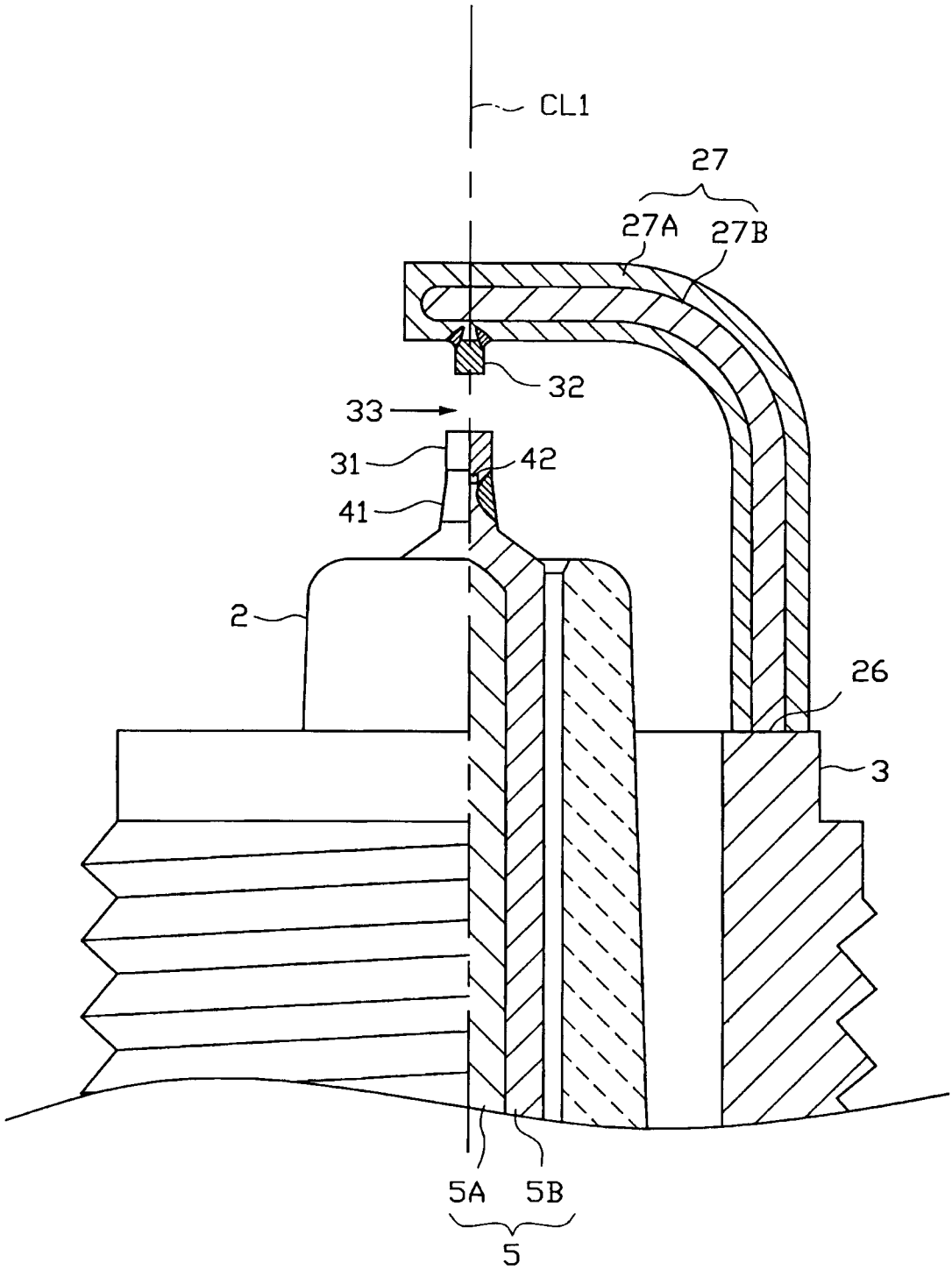
FIG. 2 is an enlarged partial-cross-sectional front view showing the configuration of a leading end of the spark plug according to an exemplary embodiment.

In this embodiment, as shown in FIG. 2, the noble metal tip 31 is joined to the center electrode 5 via a molten portion 41, which is formed after the noble metal alloy constituting the noble metal tip 31 and the Ni alloy constituting the center electrode 5 (the outer layer 5B thereof) are welded to each other and then are solidified. In addition, a cylindrical columnar shaped closed space 42 is formed between the center electrode 5 and the center portion of the basal end portion of the noble metal tip 31, as best seen in FIG. 3.

Figure 3:
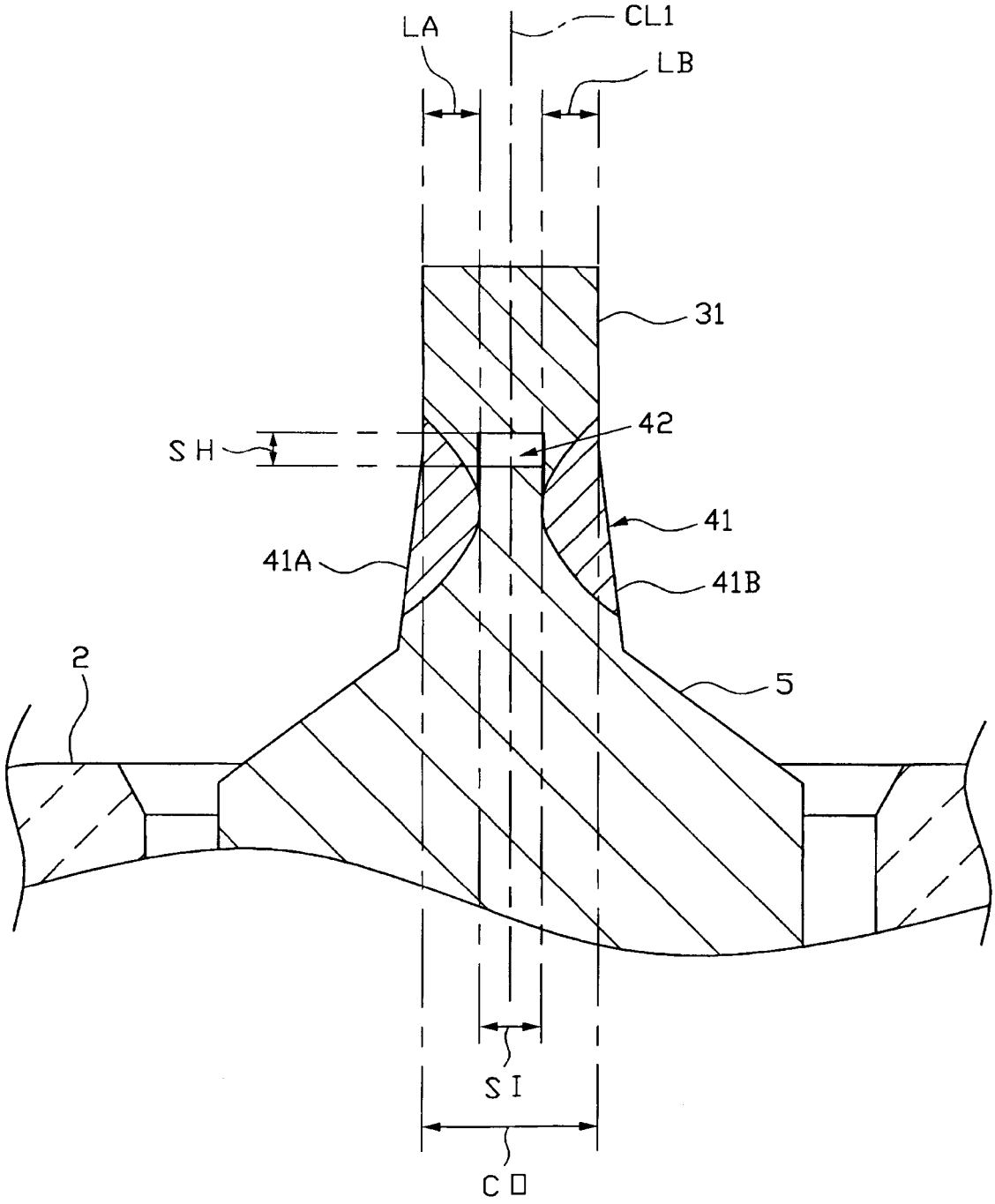
FIG. 3 is an enlarged partial-cross-sectional view showing a joined state of a noble metal tip to a center electrode.

As shown in FIG. 3, when the spark plug 1 is viewed in a cross section including the axis CL1, a width (outer diameter) CO (mm) of the noble metal tip 31 and a width SI (mm) of the closed space 42 satisfy $SI \leq CO/2$. A length (height) of the closed space 42 along the axis CL1 SH (mm) satisfies $SH \leq SI$.

In addition, when a molten depth of a molten portion 41A positioned at one side along the axis CL1 in the molten portion 41 is LA (mm) and a molten depth of a molten portion 41B positioned at the other side along the axis CL1 is LB (mm), the molten depth of the molten portion 41 is set to satisfy $LA \geq [(CO-SI)/2] \times 0.7$ and $LB \geq [(CO-SI)/2] \times 0.7$.

As used herein, the phrase the 'width of the molten portion' shall mean the length along a direction perpendicular to the axis line CL1 between the portion positioned at the most leading end side of the molten portion 41A(41B) in a direction of the axis CL1 and the portion positioned at the innermost position of the molten portion 41A(41B).

In addition, the molten portion 41 is formed such that the molten portion 41 does not extend to, or is not exposed to, the closed space 42.

Next, a method for manufacturing the spark plug 1 configured as described above will be described. First, the metal shell 3 is pre-manufactured. That is, a cold forging operation is performed on a cylindrical columnar metal material (e.g., iron material or stainless steel material such as S17C or S25C) to form a through hole therein and to manufacture a rough shape to the metal material. Subsequently, a cutting operation is performed on the metal material so as to impart a predetermined outer shape to the metal material to thereby obtain a metal shell intermediate.

Subsequently, the straight rod-shaped ground electrode 27 made of a Ni alloy is resistance-welded to the leading end surface of the metal shell intermediate. Since a so-called "sagging" is produced as a result of the welding, the "sagging" is removed. Subsequently, the threaded portion 15 is formed in a predetermined region of the metal shell intermediate by means of rolling. Thus, the metal shell 3 to which the ground electrode 27 has been welded is obtained. Zinc plating or nickel plating is performed on the metal shell 3 to which the ground electrode 27 has been welded. Notably, in order to improve corrosion resistance, a chromate treatment may be performed on the surface.

In addition, the noble metal tip 32 is joined to the leading end portion of the ground electrode 27 by the resistance welding, laser welding or the like. (e.g. arc welding, gas wadding, electron beam welding, laser beam welding, plasma flame or the like). In this instance, in order to more reliably perform the welding, the plating is removed from the portion to be welded prior to the corresponding welding, or a masking step is performed on the portion to be welded in the plating process.

Separately from the metal shell 3, the insulator 2 is mold-manufactured. For example, an agglomerated material of basic metal is prepared by using raw powder including alumina as a main component thereof and a binder and the like. The agglomerated material is subjected to rubber press mold to obtain a cylindrical molding. The obtained molding is subjected to a grinding process to form the shape, and the formed molding is inserted into a firing furnace to obtain the insulator 2.

Figure 4:
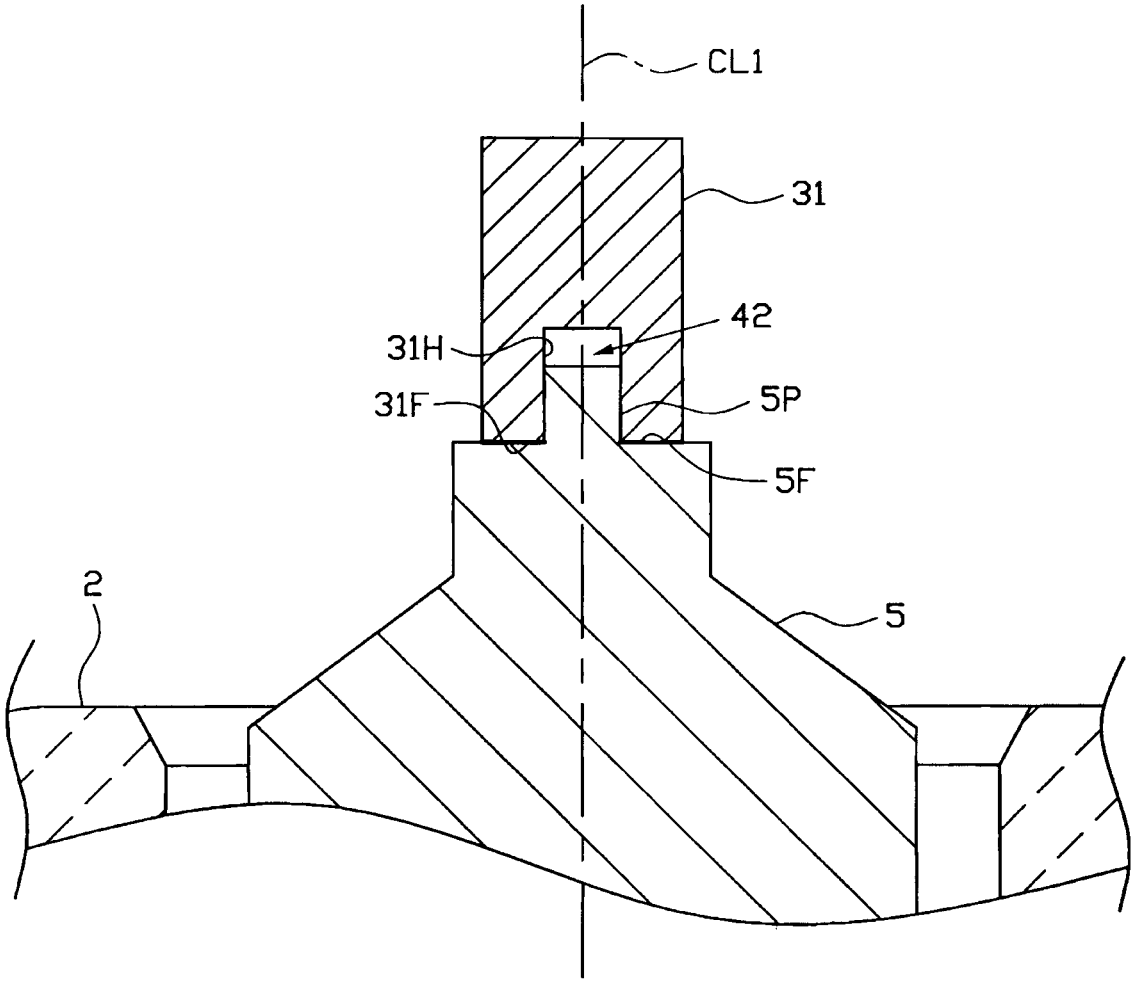
FIG. 4 is an enlarged partial-cross-sectional view showing a center electrode and a noble metal tip before joining of the noble metal tip.

Further, differently from the metal shell 3 and the insulator 2, the center electrode 5 is fabricated. That is, a forging process is performed on a Ni alloy with a copper alloy placed at a center portion thereof so as to enhance a heat radiation performance, thereby obtaining a rod-shaped member of a cylindrical columnar shape. As shown in FIG. 4, the leading end portion of the rod-shaped member is subjected to a cutting process to fabricate the center electrode 5 with a projection 5P protruding from the leading end surface.

Meanwhile, the noble metal tip 31 is fabricated. That is, an ingot containing iridium as a main component thereof is prepared, and the ingot is subjected to hot forging or hot rolling (groove roll rolling). After that, a wiredrawing process is performed on the rolled ingot to obtain a rod-shaped material. The rod-shaped material is then cut to have a predetermined length. A hole 31H, into which the projection 5A of the center electrode 5 is to be fitted, is formed on the end surface of the obtained cylindrical columnar tip member, thereby obtaining the noble metal tip 31. In this instance, the depth of the hole 31H is longer than the height of the projection 5P.

Next, the noble metal tip 31 is joined to the center electrode 5. More specifically, the projection 5P of the center electrode 5 is fitted into the hole 31H of the noble metal tip 31, and the leading end surface 5F of the center electrode 5 comes into contact with the basal end surface 31F of the noble metal tip 31. In the embodiment as described above, since the depth of the hole 31H is higher than the height of the projection 5P, a closed space 42 is formed between the bottom surface of the hole 31H and the leading end surface of the projection 5P. Then, while the center electrode 5 is rotated around the axis CL1 as a center axis, a laser beam intermittently irradiates an outer edge of a boundary portion between the center electrode 5 and the noble metal tip 31. Accordingly, a molten portion 41 is formed to have an annular cross section perpendicular to the axis CL1, and the noble metal tip 31 is joined to the center electrode 5. In accordance with one aspect of the present invention, during the laser welding step, the output of the laser welding is adjusted so that the molten portion 41 does not extend to and is not exposed to the closed space 42 and the molten depths LA and LB satisfy $LA \geq [(CO-SI)/2] \times 0.7$ and $LB \geq [(CO-SI)/2] \times 0.7$. In addition, the laser welding is performed so as to form the molten portion 41 at least at the contact portion (the portion indicated by the thick line in FIG. 4) between the leading end surface 5F of the center electrode 5 and the basal end surface 31F of the noble metal tip 31. In this instance, the projection 5P and the hole 31H correspond to the stopper of the invention.

Next, the insulator 2 and the center electrode 5 which are obtained by the above description, and the resistor 7 and the terminal electrode 6 are sealed and fixed by glass seal layers 8 and 9. In general, the glass seal layers 8 and 9 are formed of a mixture of borosilicate glass and metal powder. The mixture is charged in the axial hole 4 of the insulator 2 in such a manner that the resistor 7 is disposed between upper and lower layers of the mixture. While the mixture is pressed from the rear side towards the terminal electrode 6, the mixture is heated within a firing furnace, so that the mixture is fired and solidified. In this instance, a glaze layer may be simultaneously formed on the surface of the rear end-side body 10 of the insulator 2 through firing. Alternatively, the glaze layer may be formed in advance.

After that, the insulator 2 having the center electrode 5 and the terminal electrode 6 which are fabricated as described above, and the metal shell 3 having the ground electrode 27 which is fabricated as described above are assembled together. More specifically, the insulator 2 is fixed by crimping radially inward the rear end-side opening portion of the metal shell 3 which is relatively thin, i.e., by forming the crimping portion 20.

Finally, the spark plug 1 is obtained by bending the middle portion of the ground electrode 27 toward the center electrode 5 and performing a process so as to adjust the size of the spark discharge gap 33 between the noble metal tips 31 and 32.

As described in detail above, according to this embodiment, the relative movement of the noble metal tip 31 in a radial direction with respect to center electrode 5 is restricted by the projection 5P and the hole 31H which serve as a stopper. For this reason, at the time of welding, it is possible to more reliably prevent the size of the molten portion 41 from being different due to the eccentricity of the noble metal tip 31, thereby promoting the improvement of the welding strength.

Further, in this embodiment, the closed space 42 is formed between the center electrode 5 and the center portion of the basal end portion of the noble metal tip 31. That is, at the time of the welding of the noble metal tip 31, the molten portion 41 is formed in the state in which the space is formed between the center electrode 5 and the noble metal tip 31. Accordingly, as compared with a state in which the whole area of the leading end surface of the center electrode 5 comes into contact with the whole area of the basal end surface of the noble metal tip 31, the contact portion between the center electrode 5 and the noble metal tip 31 is decreased, so that the molten portion 41 can be formed on the overall area of the contact portion between the center electrode 5 and the noble metal tip 31, without increasing the melting energy. As a result, while preventing the adhering of the melting metal to the leading end surface of the noble metal tip 31 which causes the wear resistance and the ignitability to deteriorate, it is possible to relieve the stress generated between the center electrode 5 and the noble metal tip 31, thereby improving the peeling resistance of the noble metal tip 31.

With the following conditions, SI≤CO/2 or SH≤SI met, the noble metal tip 31 has an annular portion formed around the closed space 42 that has sufficient sectional area to serve as a heat transfer path and simultaneously defining a relatively short heat transfer path. For this reason, it is possible to sufficiently ensure the heat-drawing (heat-transferring) performance of the noble metal tip 31, thereby promoting the wear resistance.

In addition, since the depth of the hole 31H is higher than the height of the projection 5P, when the noble metal tip 31 is placed on the center electrode 5 at the time of welding, it is possible to more reliably bring the leading end surface 5F of the center electrode 5 into contact with the basal end surface 31F of the noble metal tip 31. For this reason, the molten portion 41 can be more reliably formed, and the center electrode 5 and the noble metal tip 31 can be more strongly joined to each other.

In addition, since the molten portion 41 is formed in such a manner that it does not extend to and is not exposed to the closed space 42, it more reliably prevents generation of a blow hole on the molten portion 41, so that it is possible to effectively prevent the strength of the molten portion 41 from being deteriorated.

Moreover, the molten portion 41 of which the molten depth LA and LB are formed to be sufficiently deepened by 0.7 times of the half [(CO−SI)/2] of the length of the contact region between the noble metal tip 31 and the center electrode 5. That is, it is possible to more reliably absorb the stress difference occurring between the center electrode 5 and the noble metal tip 31 by the sufficiently deep molten portion 41 with the excellent strength. As a result, it is possible to prevent to the maximum extent the development of the oxidized scale between the center electrode 5 and the noble metal tip 31, thereby further improving the peeling resistance of the noble metal tip 31.

Next, a verifying test for welding misalignment was performed so as to verify the effect to be obtained by this embodiment. A summary of the verifying test for welding misalignment is as follows. Five samples of the embodiment were fabricated where a projection was formed on a center electrode, a hole was formed in a cylindrical columnar noble metal tip, the projection was fitted into the hole, and then the center electrode and the noble metal tip were welded to each other by laser welding. Also, five samples of comparative example were fabricated where a leading end surface of a center electrode and a basal end surface of a noble metal tip were respectively formed to be flat and were joined, and then the center electrode and the noble metal tip were welded to each other by laser welding. After each of the fabricated samples was cut in a surface including the axis, molten depths LA and LB of two molten portions were measured at the cross section, and an absolute value of a difference of two molten depths was obtained. Table 1 shows the molten depths LA and LB, an average value (LA+LB)/2 of the molten depths, and an absolute value |LA−LB| of the molten depths for the comparative example. In addition, Table 2 shows the molten depths LA and LB, an average value (LA+LB)/2 of the molten depths, and an absolute value |LA−LB| of the molten depths for the embodiment. In this embodiment, in each of the samples, a cylindrical columnar tip having an outer diameter of 0.6 mm and a length of 0.8 mm was used as the noble metal tip. In addition, the noble metal tip was joined by 20 W irradiation energy of laser beam.

TABLE 1

| | Comparative examples | | | |
|---|---|---|---|---|
| | LA(mm) | LB(mm) | (LA + LB)/2(mm) | \|LA − LB\|(mm) |
| Sample 1 | 0.189 | 0.240 | 0.215 | 0.051 |
| Sample 2 | 0.260 | 0.201 | 0.231 | 0.059 |
| Sample 3 | 0.263 | 0.134 | 0.199 | 0.129 |
| Sample 4 | 0.184 | 0.248 | 0.216 | 0.064 |
| Sample 5 | 0.221 | 0.124 | 0.173 | 0.097 |

TABLE 2

| | Embodiment examples | | | |
|---|---|---|---|---|
| | LA(mm) | LB(mm) | (LA + LB)/2(mm) | \|LA − LB\|(mm) |
| Sample 1 | 0.244 | 0.233 | 0.239 | 0.011 |
| Sample 2 | 0.239 | 0.245 | 0.242 | 0.006 |
| Sample 3 | 0.241 | 0.250 | 0.246 | 0.009 |
| Sample 4 | 0.233 | 0.238 | 0.236 | 0.005 |
| Sample 5 | 0.251 | 0.238 | 0.245 | 0.013 |

As shown in Table 1, for the samples (Samples 1 to 5) of the comparative example, because the values of (LA+LB)/2 are very different, and the values of |LA−LB| are at least 0.05 mm or more, it is clear that a size of the molten portion was different. It seems that at the time of laser welding, a center axis of the noble metal tip is offset from a center axis of the center electrode by the rotation of the center electrode and the noble metal tip, so that the distance from a laser radiation port to an object to be irradiated is different, i.e., varies as the center electrode rotates.

Meanwhile, as shown in Table 2, for the samples (Samples 6 to 10) of the embodiment, since values of (LA+LB)/2 are not substantially different, and values of |LA−LB| are very small, it would be understood that a size of the molten portion is almost uniform. It seems that by installing the projection and the hole, it is possible to prevent the relative movement of the noble metal tip with respect to the center electrode, and it is possible to effectively prevent the distance from the laser radiation port to the object to be irradiated from being different.

Figure 5A:
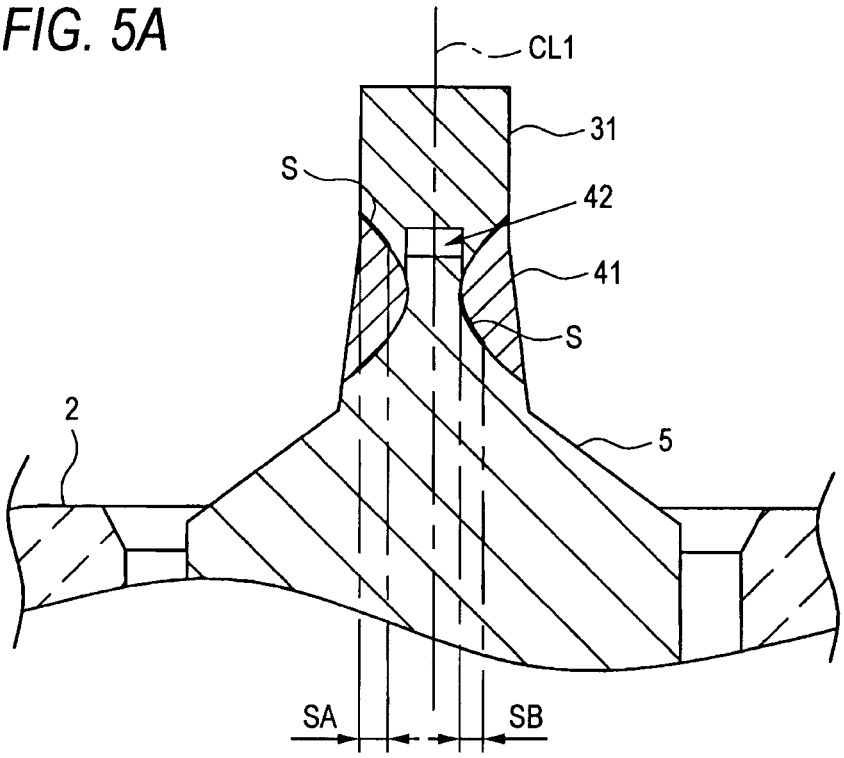
FIG. 5A is an enlarged cross-sectional diagram illustrating a size of an oxidized scale in a sample according to an exemplary embodiment.
Figure 5B:
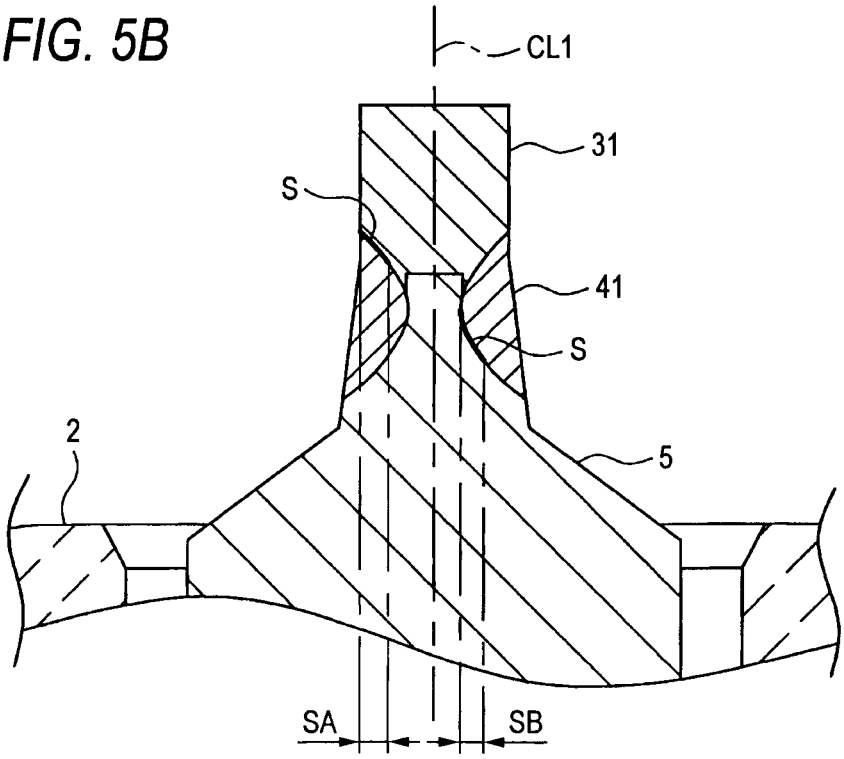
FIG. 5B is an enlarged cross-sectional diagram illustrating a size of an oxidized scale in a sample according to a comparative example.

Next, five samples of the embodiment were fabricated, where a closed space was formed between the center electrode and the noble metal tip, and the molten portion was formed by 20 W or 25 W irradiation energy of laser beam. Also, five samples of the comparative example were fabricated, where a closed space was not formed between the center electrode and the noble metal tip, and the molten portion was formed by 20 W or 25 W irradiation energy of laser beam. Then, an evaluating test for peeling resistance was performed. A summary of an evaluating test for peeling resistance is as follows. Each of the samples was repeatedly subjected to heating and cooling for 1000 cycles, in which slow cooling for one minute after heating the noble metal tip up to 900° C. is defined as one cycle. After completion of 1000 cycles, the cross-section of each sample was examined. Distances SA and SB (shown in FIGS. 5A and 5B) along a direction perpendicular to the axis CL1 of the oxidized scale S (the portion indicated by the thick line in FIG. 5) formed between the noble metal tip or the center electrode, and the molten depths LA and LB were measured, respectively. After that, a development ratio (%) of the oxidized scale was obtained by multiplying a value which is obtained from division of the total (SA+SB) of the measured lengths of the oxidized scale by the total (LA+LB) of the molten depths, by 100. In this instance, in a case where plural oxidized scales are formed on the cross section of one molten portion, the distances SA and SB are obtained by adding all distances of the respective oxidized scales.

In addition, a plurality of samples with the closed space according to the embodiment and a plurality of samples with no closed space according to the comparative example were fabricated while changing the irradiation energy as described above. The surfaces of the respective samples were observed to measure a fabricating ratio (sputter generating ratio) of a sample in which the molten metal was attached to the leading end surface of the noble metal tip.

Table 3 shows a development ratio of the oxidized scale and an average value of the development ratio for the samples of the comparative example in the case where the irradiation energy was 20 W and a case where the irradiation energy was 25 W. In addition, Table 4 shows a development ratio of the oxidized scale and an average value of the development ratio for the samples of the embodiment in the case where the irradiation energy was 20 W and a case where the irradiation energy was 25 W. Moreover, Table 5 shows a sputter generating ratio for the samples of the comparative example and the samples of the embodiment in the case where the irradiation energy was 20 W and a case where the irradiation energy was 25 W.

TABLE 3

| | Comparative example | |
|---|---|---|
| | Radiation Energy (20 W) | Radiation Energy (25 W) |
| Sample 11 | 41.4% | 14.2% |
| Sample 12 | 38.1% | 8.7% |
| Sample 13 | 34.3% | 11.8% |
| Sample 14 | 22.3% | 0.0% |
| Sample 15 | 36.0% | 5.8% |
| Average Value | 34.4% | 8.1% |

TABLE 4

| | Embodiment | |
|---|---|---|
| | Radiation Energy (20 W) | Radiation Energy (25 W) |
| Sample 16 | 5.7% | 3.7% |
| Sample 17 | 13.1% | 5.1% |
| Sample 18 | 4.9% | 0.0% |
| Sample 19 | 11.2% | 2.1% |
| Sample 20 | 8.7% | 0.0% |
| Average Value | 8.7% | 2.2% |

TABLE 5

| | Radiation Energy (20 W) | | Radiation Energy (25 W) | |
|---|---|---|---|---|
| | Comparative example | Embodiment | Comparative example | Embodiment |
| Sputter Generating Ratio | 0.04% | 0.02% | 1.02% | 0.89% |

As shown in Table 3, it would be found that the oxidized scale was easily generated for the sample (Samples 11 to 15) of the comparative example when the irradiation energy was relatively low of 20 W. Meanwhile, it could suppress the generation of the oxidized scale by relatively increasing the irradiation energy to 25 W, but, as shown in Table 5, it was clear that the sputter generating ratio was relatively increased as the irradiation energy was increased.

As shown in Table 4, it would be found that the samples (Samples 16 to 20) of the embodiment had the same development ratio of the oxidized scale as that of the samples of the comparative example, in which the irradiation energy was 25 W, even though the irradiation energy was relatively low as 20 W (i.e., condition capable of suppressing the sputter generating ratio). It seems that since the contact portion between the center electrode and the noble metal tip is decreased by forming the closed space between the noble metal tip and the center electrode, the molten portion could be formed over substantially all of the area of contact between the leading end surface of the center electrode and the basal end surface of the noble metal tip by relatively low energy.

Next, samples of spark plugs were fabricated. In these samples, the distance along the axis from the leading end surface of the noble metal tip to the molten portion was set to 0.15 mm and the width (corresponding to an inner diameter) SI of the cylindrical columnar closed space was variously altered. After each of the samples was assembled to a four-cylinder engine of 2000 cc displacement, a durability test corresponding to driving of 100,000 km was performed. After the test was completed, an increased amount of the spark discharge gap (gap increase amount) for each sample was measured. For all the samples, the outer diameter CO of the noble metal tip was set to 0.6 mm, and the height of the noble metal tip before the melting was set to 0.5 mm. In addition, the height along the axis of the closed space was set to 0.2 mm Table 6 shows an inner diameter SI of the closed space, a ratio (SI/CO) (referred to as ratio against tip radius) of the inner diameter SI of the closed space to the outer diameter CO of the noble metal tip, and a gap increase amount. In addition, Table 6 shows a graph illustrating a relationship of the ratio against tip radius and the gap increase amount.

TABLE 6

| | | | | | | | | |
|---|---|---|---|---|---|---|---|---|
| Inner Diameter of the Closed Space (mm) | 0.00 | 0.05 | 0.10 | 0.20 | 0.30 | 0.35 | 0.40 | 0.50 |
| Ratio against Tip Radius | 0.0% | 8.3% | 16.7% | 33.3% | 50.0% | 58.3% | 66.7% | 83.3% |
| Gap Increase Amount (mm) | 0.118 | 0.116 | 0.121 | 0.131 | 0.134 | 0.169 | 0.256 | 0.542 |

Figure 6:
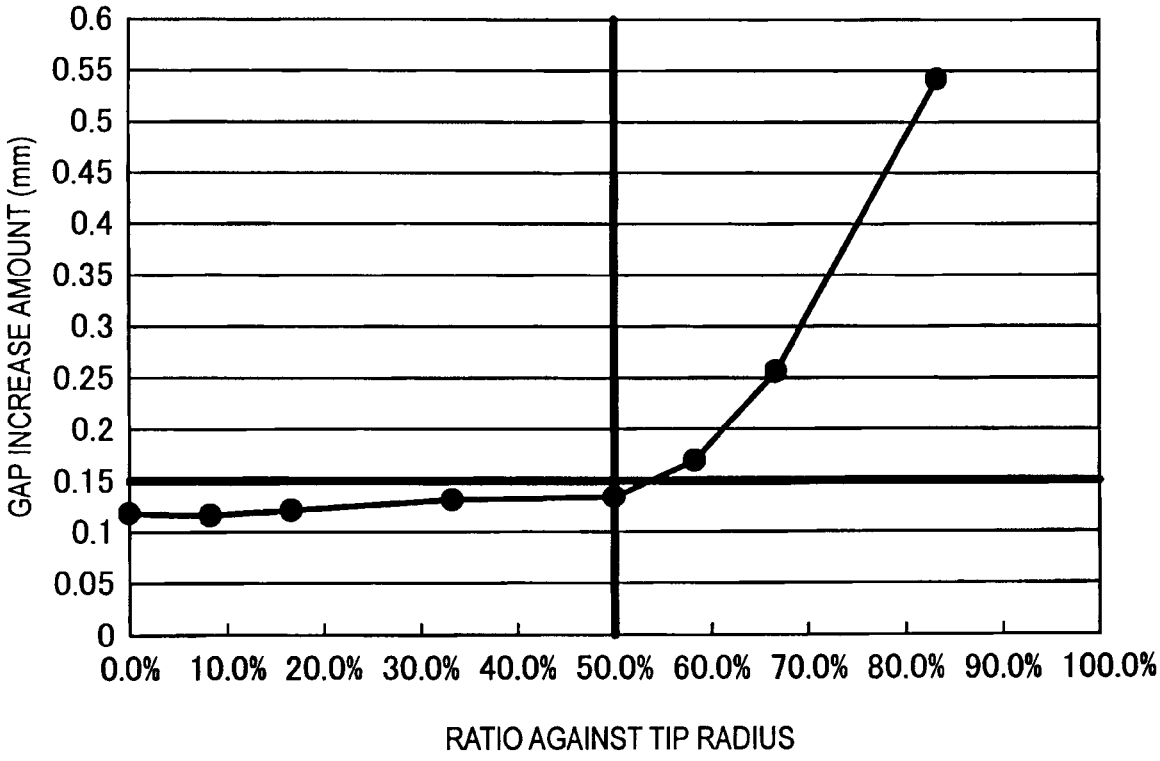
FIG. 6 is a graph showing a relationship between a gap increase amount and the ratio of the gap increase amount against the tip radius.

As shown in Table 6 and FIG. 6, it was found that for a sample of which the ratio against tip radius (SI/CO) was 50% or more, the gap increase amount was more than 0.15 mm (i.e., the molten portion is exposed to the spark discharge gap), so that the wear resistance was insufficient. Meanwhile, it was verified that for a sample of which the ratio against tip radius (SI/CO) was 50% or less, the gap increase amount was less than 0.15 mm (i.e., the molten portion is not exposed to the spark discharge gap), and thus the wear resistance was excellent. It is believed that because the annular portion positioned at the outside of the closed space is formed to have sufficiently large sectional area, the heat transfer is effectively performed from the noble metal tip to the center electrode.

Figure 7:
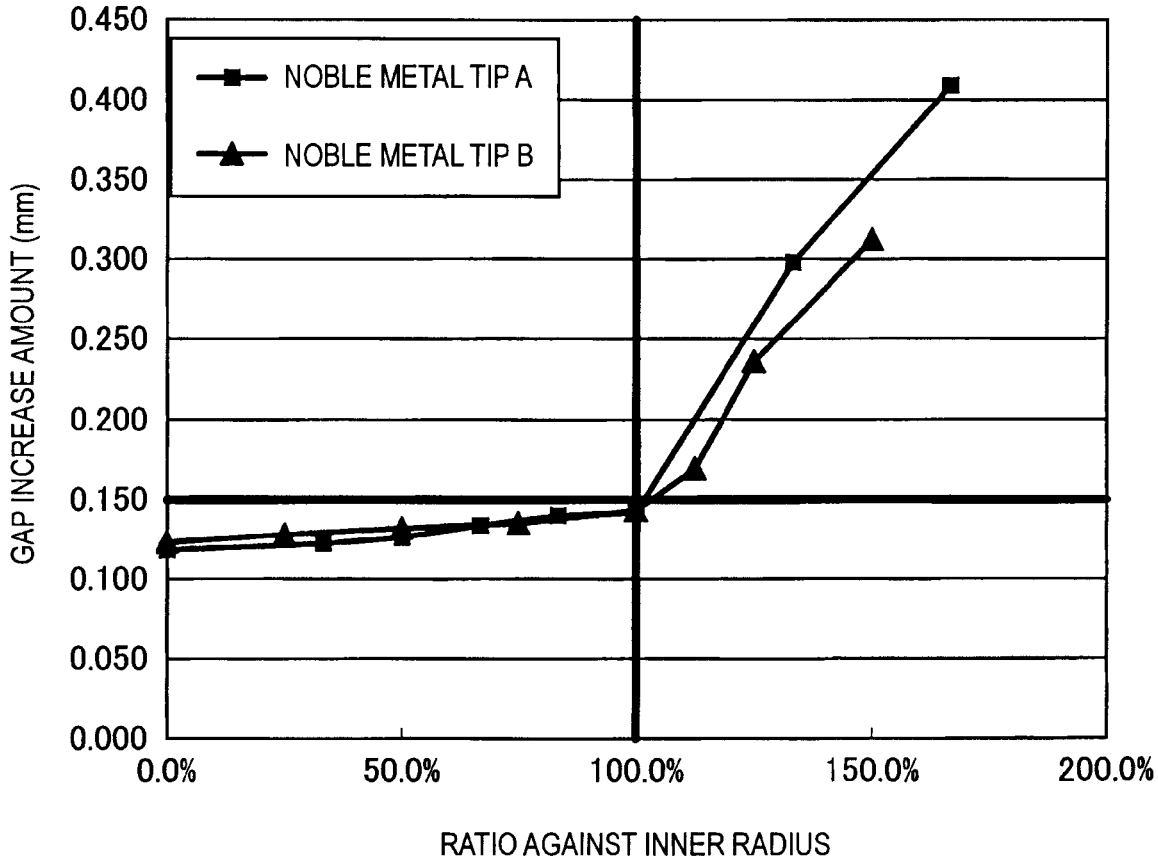
FIG. 7 is a graph showing a relationship between a gap increase amount and the ratio of the gap increase amount against inner radius.

Next, samples of the spark plug including a noble metal tip (noble metal tip A) having an outer diameter of 0.6 mm and a height of 0.5 mm prior to the melting or a noble metal tip (noble metal tip B) having an outer diameter of 0.8 mm and a height of 0.5 mm prior to the melting were fabricated. A height SH (mm) of the cylindrical columnar closed space was varied. The gap increase amount was measured by performing the durability test for each sample. In this instance, for a sample including the noble metal tip A, the inner diameter SI of the closed space was set to 0.3 mm, while for a sample including the noble metal tip B, the inner diameter SI of the closed space was set to 0.4 mm Table 7 shows the height SH of the closed space, a ratio (SH/SI) (referred to as ratio against inner radius) of the height of the closed space to the inner diameter of the closed space, and a gap increase amount for the sample including the noble metal tip A. In addition, Table 8 shows the height SH of the closed space, a ratio against inner radius, and a gap increase amount for the sample including the noble metal tip B. FIG. 7 is a graph illustrating a relationship of the ratio against inner radius and the gap increase amount for each sample. In this instance, in FIG. 7, the test result of the sample including the noble metal tip A is plotted by a black quadrangle, and the test result of the sample including the noble metal tip B is plotted by a black triangle.

TABLE 7

| Height of the Closed Space | 0.00 | 0.10 | 0.15 | 0.20 | 0.25 | 0.30 | 0.40 | 0.50 |
|---|---|---|---|---|---|---|---|---|
| Ratio against Inner Radius | 0.0% | 33.3% | 50.0% | 66.7% | 83.3% | 100.0% | 133.3% | 166.7% |
| Gap Increase Amount (mm) | 0.118 | 0.122 | 0.126 | 0.134 | 0.140 | 0.142 | 0.298 | 0.409 |

TABLE 8

| Height of the Closed Space | 0.00 | 0.10 | 0.20 | 0.30 | 0.50 | 0.45 | 0.50 | 0.60 |
|---|---|---|---|---|---|---|---|---|
| Ratio against Inner Radius | 0.0% | 25.0% | 50.0% | 75.0% | 100.0% | 112.5% | 125.0% | 150.0% |
| Gap Increase Amount (mm) | 0.123 | 0.128 | 0.132 | 0.135 | 0.143 | 0.169 | 0.236 | 0.312 |

As shown in Table 7, Table 8 and FIG. 7, it was found that for the sample having the ratio against inner radius (SH/SI) of 100% or less, the gap increase amount was less than 0.15 mm, so that good wear resistance was realized. It is believed that since the annular portion positioned at the outside of the closed space is relatively short, the heat is effectively transferred from the noble metal tip to the center electrode.

In order to promote the increase of the welding strength, considering the results of each test synthetically, it is preferable to weld the noble metal tip and the center electrode while the relative movement of the noble metal tip in a radial direction with respect to the center electrode of the noble metal tip is restricted. In order to suppress the welding fault (sputter) and the oxidized scale by one effort, it is preferable to form the closed space between the center electrode and the noble metal tip.

.In addition, in view of promoting the wear resistance, it is preferable that the inner diameter (width) of the closed space is set to be 50% or less of the outer diameter (width) of the noble metal tip (i.e., satisfying (SI≤CO)/2), and the height of the closed space is set to be the inner diameter (width) or less of the closed space (i.e., SH≤SI).

.Next, samples of the spark plug were fabricated, of which the ratio (melting ratio) of the half [(CO−SI)/2] of a difference between the width CO of the noble metal tip and the width SI of the closed space with respect to the molten depth LA and LB was varied by changing the size of the molten depths LA and LB of the molten portion. The evaluating test for peeling resistance was performed on each of the samples to obtain the development ratio of the oxidized scale. Table 9 shows the above test result. In this instance, for each sample, the molten portion was formed in such a manner that the molten depths LA and LB have the same size. In addition, the width CO of the noble metal tip was set to 0.7 mm, and the width SI of the closed space was set to 0.2 mm. Moreover, the noble metal tip was made of a Pt-5Ir alloy.

.As shown in Table 9, it was verified that, for the sample having the molten ratio of 70% or more, the development of the oxidized scale was effectively suppressed and the sample has the good peeling resistance. In addition, it was found that excellent peeling resistance can be realized by further increasing the molten ratio.

TABLE 9

| | Molten Depth $L_A(L_B)$ | | | | |
|---|---|---|---|---|---|
| | 0.100 mm | 0.150 mm | 0.175 mm | 0.200 mm | 0.250 mm |
| Melting Ratio | 40% | 60% | 70% | 80% | 100% |
| Development Ratio of The | 93.1% | 74.6% | 21.7% | 16.3% | 4.3% |

TABLE 9-continued

| | Molten Depth $L_A(L_B)$ | | | | |
|---|---|---|---|---|---|
| | 0.100 mm | 0.150 mm | 0.175 mm | 0.200 mm | 0.250 mm |
| Oxidized Scale | | | | | |

From the above results, it is preferable that in order to further promote the increase of the peeling resistance, the molten ratio, namely, [(CO−SI)/2]/LA and [(CO−SI)/2]/LB are set to be 0.7 or more. In addition, in order to further increase the peeling resistance, the molten ratio is preferably set to be 0.8 or more, and the molten ratio is more preferably set to be 1.0 or more.

However, it is preferable that in view of preventing the strength of the molten portion from being lowered by preventing generation of the blow hole at the time of forming the molten portion, the molting ratio is set in such a manner that the molten portion is not exposed to the closed space.

Additional Modifications

In this instance, it should be noted that the invention is not limited to details of above-described embodiment, and may be implemented as follows or as other applications and modifications which are not illustrated below.

Figure 8:
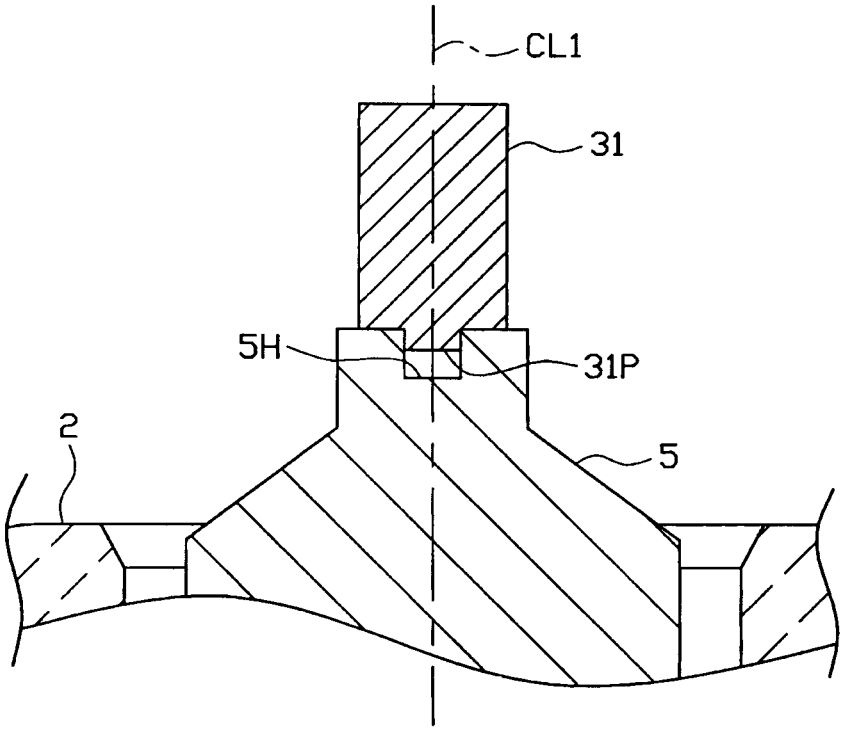
FIG. 8 is an enlarged partial-cross-sectional view showing the configuration of a center electrode and noble metal tip according to another exemplary embodiment.

(a) In the embodiment, although the stopper restricting the relative movement of the noble metal tip 31 in a radial direction with respect to the center electrode 5 is constituted of the projection 5P formed on the center electrode 5 and the hole 31H formed in the noble metal tip 31, the configuration of the stopper is not limited thereto. Consequently, as shown in FIG. 8, the stopper may be constituted of a hole 5H formed in the center electrode 5, and the projection 31P formed on the noble metal tip 31 and fitted into the hole 5H.

Figure 9:
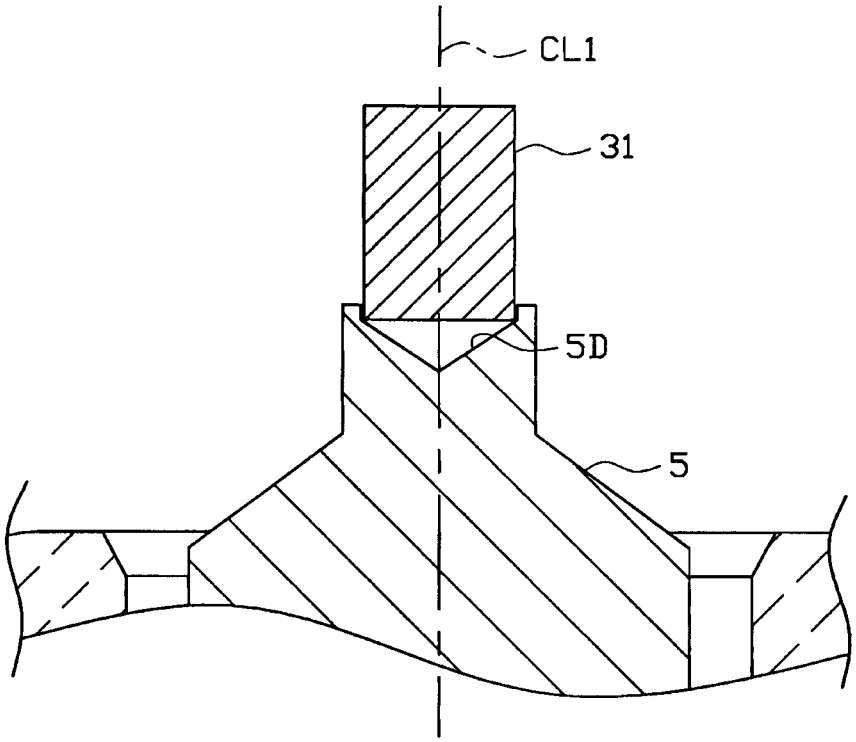
FIG. 9 is an enlarged partial-cross-sectional view showing the configuration of a center electrode and noble metal tip according to another exemplary embodiment.
Figure 10:
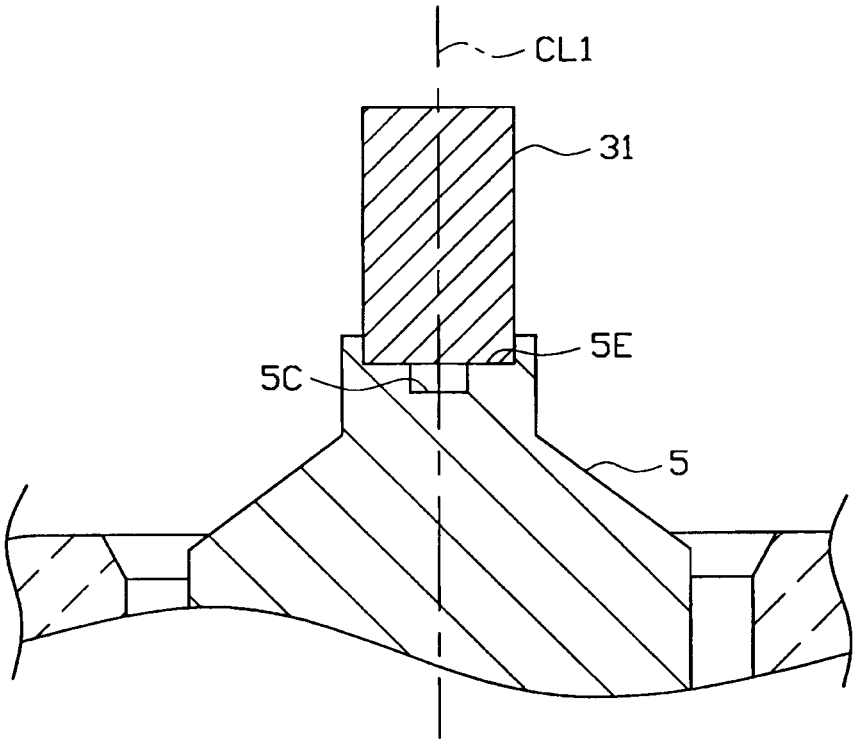
FIG. 10 is a partially-enlarged cross-sectional view showing the configuration of a center electrode and noble metal tip according to another embodiment.

In addition, in view of the increased cost according to the formation of the hole 31H or the projection 31P on the noble metal tip 31, as shown in FIGS. 9 and 10, the relative movement of the noble metal tip 31 in a radial direction with respect to the center electrode 5 may be restricted by installing concave portions 5D and 5E in the center electrode 5 as the stopper without special process on the noble metal tip 31. In this instance, in the case where the concave portions 5D and 5E may be formed in a tapered shape, as shown in FIG. 9, or as shown in FIG. 10, the hole 5C may be formed in the bottom surface of the concave portion 5E (FIGS. 8 to 10 illustrate the state prior to formation of the molten portion 41). In this instance, in FIG. 9, when the center electrode 5 is joined to the noble metal tip 31, the outer peripheral portion of the concave portion 5D is welded to the outer peripheral portion of the basal end surface of the noble metal tip 31.

(b) In the embodiment heretofore described, although a noble metal tip 32 is installed on the leading end portion of the ground electrode 27, the noble metal tip 32 may be omitted from the ground electrode 27.

(c) In the embodiments heretofore described, although the closed space 42 is cylindrical in shape, and has a rectangular shape when viewed in the cross section including the axis CL1, the shape of the closed space is not limited thereto. Accordingly, in the cross section including the axis CL1, the closed space 42 may be formed in a triangular shape or trapezoidal shape. In this instance, the width SI of the closed space 42 means the maximum width value of the closed space 42, and the height SH of the closed space 42 means the maximum height value of the closed space 42.

(d) In the embodiment, the case in which the ground electrode 27 is joined to the leading end portion 26 of the metal shell 3 is exemplified, but the invention is also applicable to a case in which the ground electrode is formed as an integral part of the metal shell, for example, in such a manner as to grind down a portion of the metal shell (or a portion of a tip shell welded in advance to the metal shell) (e.g., refer to JP-A-2006-236906). Also, the ground electrode 27 may be joined to the side surface of the leading end portion 26 of the metal shell 3.

(e) Although the tool engaging portion 19 is provided with a hexagonal cross-sectional shape, the shape of the tool engaging portion 19 is not limited thereto. For example, the tool engaging portion 19 may have a Bi-HEX (modified 12-point) shape [ISO22977:2005(E)] or the like.

While the present invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A spark plug for an internal combustion engine, the spark plug comprising:

a center electrode extending along an axis and having a leading end portion and an outer peripheral surface;

an insulator of a cylindrical shape, the insulator provided about the outer peripheral surface of the center electrode and having an outer peripheral surface;

a metal shell of a cylindrical shape, the metal shell provided about the outer peripheral surface of the insulator and having a leading end portion;

a noble metal tip provided at the leading end portion of the center electrode, the noble metal tip including a leading end portion and a basal portion;

a ground electrode, one end of the ground electrode fixed at the leading end portion of the metal shell, and the other end of the ground electrode forming a gap with the leading end portion of the noble metal tip;

a stopper provided on at least one of the center electrode and the noble metal tip, the stopper preventing the noble metal tip from moving relative to the central electrode;

a molten portion welding the center electrode and at least a part of the basal portion of the noble metal tip; and a closed space formed between a center part of the basal portion of the noble metal tip and the center electrode, wherein when the spark plug is viewed in a cross section including the axis, a width of the noble metal tip CO, a maximum width of the closed space SI, and a height of the closed space SH satisfy the following relationships:

$SI \leq CO/2$; and $SH \leq SI$.

2. A spark plug for an internal combustion engine, the spark plug comprising:

a center electrode extending along an axis and having a leading end portion and an outer peripheral surface;

an insulator of a cylindrical shape, the insulator provided about the outer peripheral surface of the center electrode and having an outer peripheral surface;

a metal shell of a cylindrical shape, the metal shell provided about the outer peripheral surface of the insulator and having a leading end portion;

a noble metal tip provided at the leading end portion of the center electrode, the noble metal tip including a leading end portion and a basal portion;

a ground electrode, one end of the ground electrode fixed at the leading end portion of the metal shell, and the other end of the ground electrode forming a gap with the leading end portion of the noble metal tip;

a stopper provided on at least one of the center electrode and the noble metal tip, the stopper preventing the noble metal tip from moving relative to the central electrode;

a molten portion welding the center electrode and at least a part of the basal portion of the noble metal tip; and a closed space formed between a center part of the basal portion of the noble metal tip and the center electrode, wherein when the spark plug is viewed in a cross section including the axis, a width of the basal portion of the noble metal tip CO, a maximum width of the closed space SI, a depth of the molten portion at one side of the axis LA, and a depth of the molten portion at the other side of the axis LB satisfy the following relationships:

$$SI<CO$$

$$LA \geq \{(CO-SI)/2\} \times 0.7; \text{ and}$$

$$LB \geq \{(CO-SI)/2\} \times 0.7.$$

3. The spark plug according to claim 1 or 2, wherein the molten portion is formed by irradiating laser or electron beam.

4. The spark plug according to claim 1 or 2, wherein the stopper is provided as a portion of the noble metal tip or the center electrode.

5. The spark plug according to claim 1 or 2, wherein the molten portion is not exposed to the closed space.

* * * * *